US009868143B2

(12) United States Patent
Zimmerman

(10) Patent No.: US 9,868,143 B2
(45) Date of Patent: Jan. 16, 2018

(54) SYSTEM AND METHOD FOR A PAINTLESS DENT REPAIR TOOL

(71) Applicant: Todd Zimmerman, Highland, CA (US)

(72) Inventor: Todd Zimmerman, Highland, CA (US)

( * ) Notice: Subject to any disclaimer, the term of this patent is extended or adjusted under 35 U.S.C. 154(b) by 0 days.

(21) Appl. No.: 15/418,718

(22) Filed: Jan. 28, 2017

(65) Prior Publication Data

US 2017/0216899 A1 Aug. 3, 2017

Related U.S. Application Data

(60) Provisional application No. 62/288,426, filed on Jan. 28, 2016.

(51) Int. Cl.
*B21D 1/06* (2006.01)

(52) U.S. Cl.
CPC ..... *B21D 1/06* (2013.01)

(58) Field of Classification Search
CPC .. B21D 1/06; B21D 1/12; B21D 37/02; Y10S 72/705
USPC ..... 72/457, 705, 477, 479
See application file for complete search history.

(56) References Cited

U.S. PATENT DOCUMENTS

| | | | | |
|---|---|---|---|---|
| 2,763,172 | A * | 9/1956 | Richards | B21D 1/06 403/343 |
| 3,416,353 | A * | 12/1968 | Hopkins | B21D 1/12 72/446 |
| 5,461,900 | A * | 10/1995 | Gutierrez | B21D 1/06 72/479 |
| 5,479,804 | A | 1/1996 | Cook | |
| 6,474,198 | B2 * | 11/2002 | Lowther | B21D 1/06 173/90 |
| 6,536,250 | B1 | 3/2003 | Borchert | |
| 6,609,682 | B2 * | 8/2003 | Rogers | B64C 25/64 188/129 |
| 6,957,561 | B1 | 10/2005 | Contreras | |
| 2005/0252271 | A1 * | 11/2005 | Fredenberg | B21D 1/06 72/457 |
| 2009/0056407 | A1 * | 3/2009 | Greene | B25D 3/00 72/481.1 |

* cited by examiner

*Primary Examiner* — R. K. Arundale
*Assistant Examiner* — Pradeep C Battula
(74) *Attorney, Agent, or Firm* — Loza & Loza, LLP; Jessica Smith

(57) ABSTRACT

A paintless dent removal (PDR) tool includes a detachable head, tubing assembly and handle. The tubing assembly includes a plurality of tubing segments having different lengths that are detachable and interchangeable. The length of the tubing assembly may be adjusted by attaching together one or more of the tubing segments having different lengths. One or more different types of heads may be attached to the tubing assembly depending on the type of dent to be repaired. One type of head includes a t-bar with two ends, each end configured for attachment to one of a plurality of different types of tips.

9 Claims, 12 Drawing Sheets

SYSTEM AND METHOD FOR A PAINTLESS DENT REPAIR TOOL

FIELD

This application relates to sheet metal working and more particularly for removal of dents from sheet metal surfaces.

BACKGROUND

Sheet metal is widely used as the surface skin on vehicles. Typically, this skin is rolled steel or aluminum and is relatively thin to aid in forming it to the various contours of the vehicle. In general, the surface skin is painted to provide a protective and aesthetic coating to the vehicle. Due to the thickness of the surface skin, it is quite susceptible to concave denting, frequently from projectiles like hail, rocks or other small objects impacting the sheet metal surface, and numerous other accidents and occurrences that happen in the life of every vehicle owner/operator. Often with these types of dents, even though the sheet metal is displaced from its original shape, the integrity of the paint finish is not compromised.

Methods to remove dents that involve filling, sanding and refinishing the dented area are typically time consuming and expensive. Methods that involve drilling and pulling the dent to a smooth configuration also require refinishing and are still costly. When the paint finish is not compromised, removing the dents without damage to the painted surface can be very cost effective versus removing and replacing the damaged sheet metal, particularly if the repair can be accomplished without the necessity for subsequent surface sanding, grinding or refinishing operations. This specialized technique of metal working that repairs dents without need for re-painting of the damaged area is called "paintless dent repair".

In order to perform paintless dent repair, special tools have been developed In general, these tools have a working end that may be manipulated by the user to exert force on the damaged area and restore the bent metal to a position of alignment with the surrounding area of sheet metal. However, prior art tools have disadvantages for use in a wide variety of types of paintless dent repairs.

Thus, there is a need for improved tools which can be effectively used in the field of paintless dent repair.

SUMMARY

According to a first aspect, a paintless dent removal (PDR) tool comprises at least a first type of head having a plurality of ends, wherein each of the plurality of ends are configured for attaching and detaching a plurality of different types of tips. The PDR tool further comprises a handle and a tubing assembly including a plurality of tubing segments, wherein the first type of head and the handle and the plurality of tubing segments are removably attached.

According to a second aspect, the plurality of tubing segments have a plurality of different lengths.

According to a third aspect, the plurality of tubing segments include a first tubing segment with a length $l_1$, a second tubing segment with a length $l_2$ and a third tubing segment with a length $l_3$, wherein the first length $l_1$ is greater the second length $l_2$ and the second length $l_2$ is greater than the third length $l_3$.

According to a fourth aspect, a button clip system includes a clip and a protrusion positioned on the clip. The clip is slid into a smaller diameter tube portion of a tubing segment such that the protrusion protrudes from an aperture in the smaller diameter tube portion. The clip has a frictional spring tension force that secures the protrusion in position within the aperture.

According to a fifth aspect, a leverage system includes a cross bar, a rope, pulleys and hooks. In use, when repairing dents on a roof on a vehicle, the back window or the hatch in the case of an SUV is removed. The leverage system is then positioned from right to left across the window or hatch opening. The leverage system provides a point in which to leverage the PDR tool.

DETAILED DESCRIPTION

Figure 1:
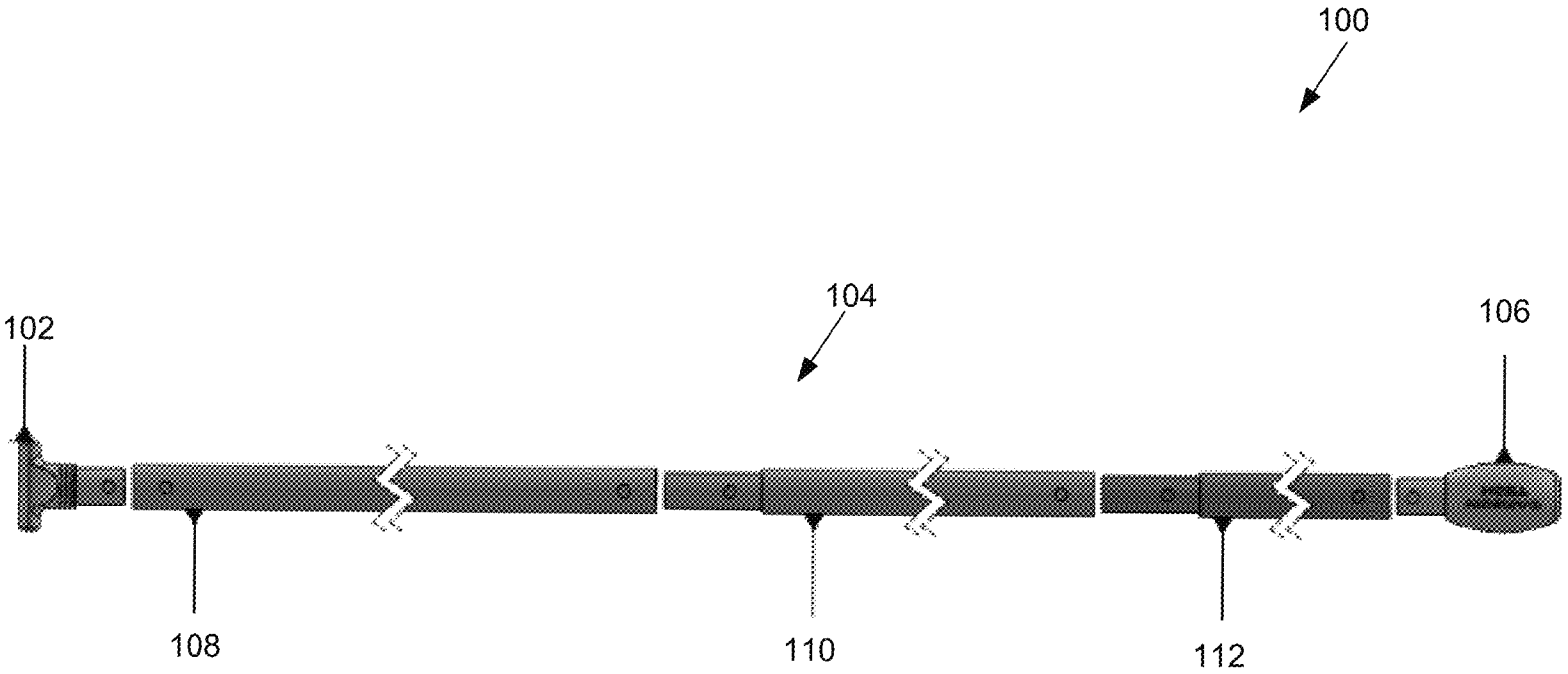
FIG. 1 illustrates a side view of an exemplary embodiment of a paintless dent repair (PDR) tool.

The word "exemplary" or "embodiment" is used herein to mean "serving as an example, instance, or illustration." Any implementation or aspect described herein as "exemplary" or as an "embodiment" is not necessarily to be construed as preferred or advantageous over other aspects of the disclosure. Likewise, the term "aspects" does not require that all aspects of the disclosure include the discussed feature, advantage, or mode of operation.

Embodiments will now be described in detail with reference to the accompanying drawings. In the following description, numerous specific details are set forth in order to provide a thorough understanding of the aspects described herein. It will be apparent, however, to one skilled in the art, that these and other aspects may be practiced without some or all of these specific details. In addition, well known steps in a method of a process may be omitted from flow diagrams presented herein in order not to obscure the aspects of the disclosure. Similarly, well known components in a device may be omitted from figures and descriptions thereof presented herein in order not to obscure the aspects of the disclosure.

To perform "paintless dent repair" (PDR), specialized technicians utilize a broad assortment of PDR tools to repair dents in sheet metal of vehicles. The PDR tools are used to apply force to the dent and restore the dent to a smooth configuration with the surrounding sheet metal without damaging the paint coating. Thus, paintless dent repair negates the costly and time consuming need for repainting and refinishing the damaged surface. Some PDR tools are long rods or tubes varying in length from two feet to over six feet. These PDR tools are generally made of either aluminum or steel. Aluminum PDR tools, while lightweight, are very flexible. This flexibility makes it more difficult to apply force to a dent and may cause the technician to waste considerable energy and time in the repair. Furthermore, aluminum PDR tools often break due to the inherent weakness of aluminum. Steel PDR tools, are quite strong and rarely break, however, steel PDR tools are also flexible, resulting in the same problems as aluminum tools. In addition, steel PDR tools are often quite heavy.

In addition, it is desirable for PDR tools to be easily transported and shipped as technicians move from different locations. However, current PDR tools are quite long and are difficult to ship and transport.

Thus, there is a need for PDR tools which are less flexible and resist breakage during use. In addition, the PDR tools should be configurable to assist a technician to repair different types of dents with less energy and time. Furthermore, PDR tools need to be more easily shipped and transported between locations.

Overview

In an embodiment, the PDR tool comprises a tubing assembly including one or more tubing segments of various lengths. The tubing segments may be assembled and disassembled in various combinations to create different lengths of the tubing assembly. The tubing assembly thus has a configurable length. As such, a technician may determine a preferred length for accomplishing a dent repair and assemble the PDR tool to the preferred length. Multiple tools of different lengths are no longer needed.

In another embodiment, the tubing segments of the PDR tool are connected using a button clip system and method, allowing for quick and easy assembly. Button clips allow for disengagement simply by pushing a built-in button on the tubing segment. The button clip system provides a very rigid joint connection as well. In contrast, other tools may use a threaded screw system which requires considerable time and energy for assembly. In addition, a threaded screw system often loosens or comes apart during use due to the rotation of the tool during the dent repair.

Thus, the PDR tool may be quickly assembled and configured into various lengths to allow for customization to the type of dent repair and preference of the technician.

In an embodiment, the tubing segments of the PDR tool comprise carbon fiber tubing. Carbon fiber results in a tool that is both stronger and considerably lighter than other PDR type tools made of steel or aluminum. In addition, the tubing segments of the PDR tool are configured with a thicker diameter and wall than current PDR tools. For example, the tubing segments may be configured, e.g., with an approximately 1¼ inch diameter and a wall thickness of approximately ⅛ inch. This increased thickness of the wall and diameter along with the carbon fiber composition creates a stronger PDR tool that is less likely to bend or break in use.

In another embodiment, a plurality of different types of heads may be attachable and detachable to one end of the tubing assembly. The type of head and handle used for a dent repair is thus configurable. For example, one type of head may be used to repair dents on a roof of a vehicle while other types of heads may be used to repair dents in bumpers or sides of the vehicle. The heads of the PDR tool are thus configurable to allow for customization to the type of dent repair and preference of the technician. Similarly, a plurality of different types of handles may be attachable and detachable to another end of the tubing assembly. Technicians may have a preference for one type of handle and thus may customize the PDR with their preferred type of handle.

The PDR tool described herein is lightweight, less flexible and stronger. The PDR tool allows technicians to remove dents more quickly and with less energy being expended than other current PDR tools. In addition, the PDR tool is designed for easy and quick assembly and disassembly such that the PDR tool may be more easily shipped and transported. Because the PDR tool may be easily disassembled, the PDR tool is more conveniently stored and shipped. The PDR tool described herein thus has the advantages, e.g, of being considerably lighter, stronger, more rigid and more adaptable than other PDR tools, resulting in the technician being able to be more energy efficient and much faster in the repair of dents.

Embodiment of the PDR Tool

FIG. 1 illustrates a side view of an exemplary embodiment of a PDR tool 100. The PDR tool includes a head 102, a tubing assembly 104 and a handle 106. The tubing assembly 104 includes a plurality of tubing segments 108, 110 and 112. The head 102, the tubing segments 108, 110, 112 and the handle 106 are removably attached.

In an embodiment, the tubing segments 108, 110, 112 have a plurality of different lengths. For example, in an embodiment, the first tubing segment 108 has a first length $l_1$, the second tubing segment 110 has a second length $l_2$, and the third tubing segment 112 has a third length $l_3$, wherein $l_1 > l_2 > l_3$. Though three tubing segments are illustrated as part of the tubing assembly 102 in the example of FIG. 1, more than three segments may be assembled as part of the tubing assembly. Alternatively, only one or two tubing segments may be assembled as part of the tubing assembly 104. The various lengths of the attachable tubing segments 108, 110, 112 also allows the PDR tool 100 to be configured to different lengths.

For example, the tubing assembly may include a 46 inch tubing segment, a 26 inch tubing segment and a 12 inch tubing segment. When the three segments are assembled, the total length of the three tubing segments is seven feet. Alternatively, various combinations of these tubing segments may be assembled to configure the length of the tubing assembly. For example, a 26 inch tubing segment and a 46 inch tubing segment may be assembled for a tubing assembly having 6 feet of length. Two 26 inch tubing segments and a 12 inch tubing segment may be assembled for a tubing assembly having a length of at least 5 feet. Two 12 inch segments and a 26 segment may be assembled for a tubing assembly having a length of at least 4 feet. These measurements are merely examples and do not include the lengths of the head and handle. The tubing assembly thus has a configurable length. As such, a technician may determine a preferred length for accomplishing a dent repair and assemble the PDR tool to the preferred length or close to the preferred length. Multiple tools of different lengths are no longer needed. Though tubing segments are illustrated having 46 in, 26 in and 12 in lengths, tubing segments having other lengths may also be implemented and assembled as part of the tubing assembly.

Figure 2A:
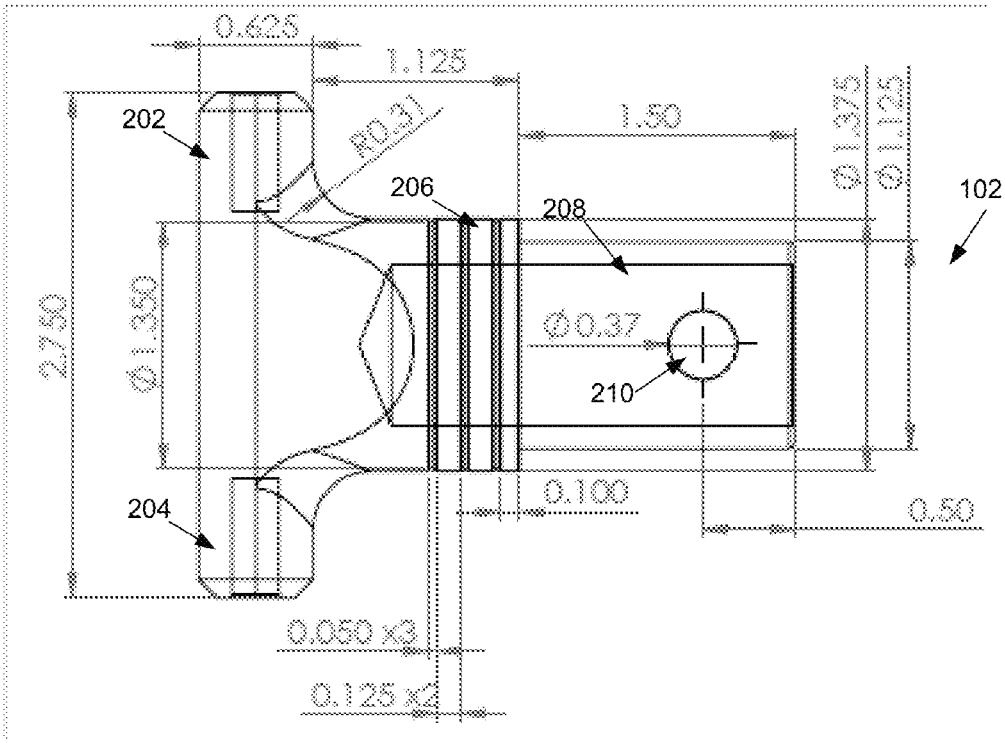
FIG. 2A illustrates a side view of an exemplary embodiment of one type of head that may be attached to the PDR tool.

FIG. 2A illustrates a side view of an exemplary embodiment of the head 102 of the PDR tool 100. The head 102 has an approximate "T" bar shape with a first end 202 and a second end 204. The first end 202 and the second end 204 are both configured with a threaded hole wherein different tips can be attached. For example, a first type of tip may be attached to the first end 202 and a second type of tip may be attached to the second end 204. Though the head 102 has two ends 202, 204 for attaching two different types of tips, the head 102 may also be configured with a third end or a fourth end for attaching a third or fourth different type of tip or may only have one end for attaching different types of tips.

A bottom end 206 of the "T" shaped head 102 forms or is fixedly attached to a smaller diameter tube attachment 208. The smaller diameter tube attachment 208 includes a clip aperture 210. The tube attachment 208 is configured to fit within the tubing assembly 104 using a button clip system as described in more detail herein.

In use, a technician may select a preferred type of tip for the dent repair and attaches the preferred type of tip to one end 202 of the head 102. The technician then aligns the selected tip onto a convex side of the dent and applies force to the dent to align it with the surrounding sheet metal. In another example, the technician may select two different types of tips needed to repair one or more dents. The technician may attach a first type of tip to a first end 202 of the head 102 and a second type of tip to a second end 204 of the head 102. The technician may then use the first end 202 with the first type of tip to repair a dent and then easily rotate the PDR tool 100 to use the second end 204 with the second type of tip to continue to repair the same dent or repair another dent. Thus, the PDR tool has multiple configurable tips that are attachable and detachable from the head 100 of the PDR tool 100. The configurable tips allow the technician to easily and quickly rotate the PDR tool 100 to utilize multiple tips during dent repair.

Figure 2B:
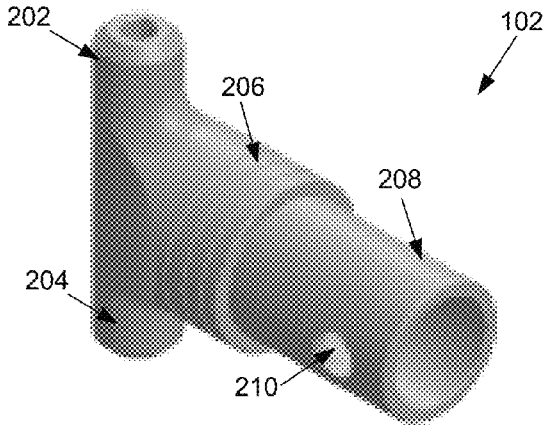
FIG. 2B illustrates an elevational view of an exemplary embodiment of one type of head that may be attached to the PDR tool.

FIG. 2B illustrates an elevational view of an exemplary embodiment of the head 102 of the PDR tool 100. The elevational view illustrates the first end 202 and the second end 204 of the "T" shaped head and the bottom end 206 of the head 102. The smaller diameter tube attachment 208 includes a clip aperture 210. Though the tubing assembly may comprise carbon fiber material, in an embodiment, the material of the head 102 may comprise aluminum, such as a machined 6061 T6 aluminum. Due to its shorter length, the head 102 is less likely to flex and the aluminum material reduces cost of the head 102.

Figure 3A:
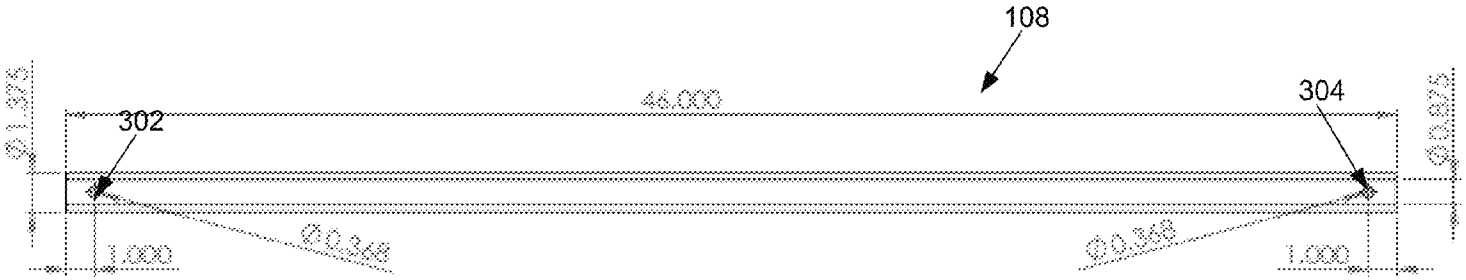
FIG. 3A illustrates a side view of an exemplary embodiment of a first tubing segment of the PDR tool.

FIG. 3A illustrates a side view of an exemplary embodiment of a first tubing segment 108 of the PDR tool 100. The first tubing segment 108 has a first length $l_1$. In an embodiment, the first length $l_1$ is approximately 46 inches. In another embodiment, the first length his in a range of approximately 40 inches to 52 inches. A first end 302 of the first tubing segment 108 has a first aperture 302 for attachment to the head 102, handle 106 or another tubing segment. A second end 304 of the first tubing segment 108 has a second aperture 304 for attachment to the head 102, handle 106 or another tubing segment.

Figure 3B:
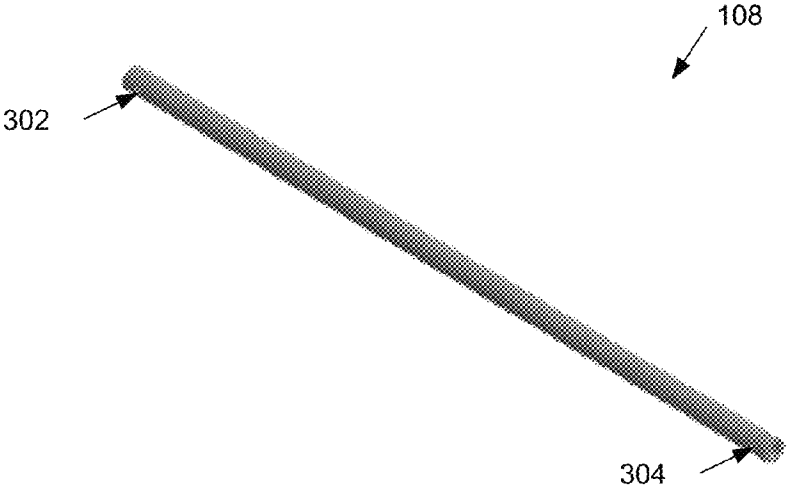
FIG. 3B illustrates an elevational view of an exemplary embodiment of a first tubing segment of the PDR tool.

FIG. 3B illustrates an elevational view of an exemplary embodiment of the first tubing segment 108 of the PDR tool 100. In an embodiment, the material of the tubing segment 108 comprises carbon fiber. Utilizing carbon fiber results in a tool that is both stronger and considerably lighter than other PDR type tools.

In addition, the tubing segment 108 is thicker in diameter and has an increased wall thickness, e.g. 1.25 inches in diameter with a wall thickness of 0.125 inch, than other types of PDR tools. In another embodiment, the diameter of the tubing segment 108 is in a range of approximately 1.1 inches to 1.4 inches and the wall thickness is in a range of 0.1 inches to 0.15 inches. This increased thickness of the diameter and wall thickness creates a stronger PDR tool that is less likely to bend in use.

Figure 4A:
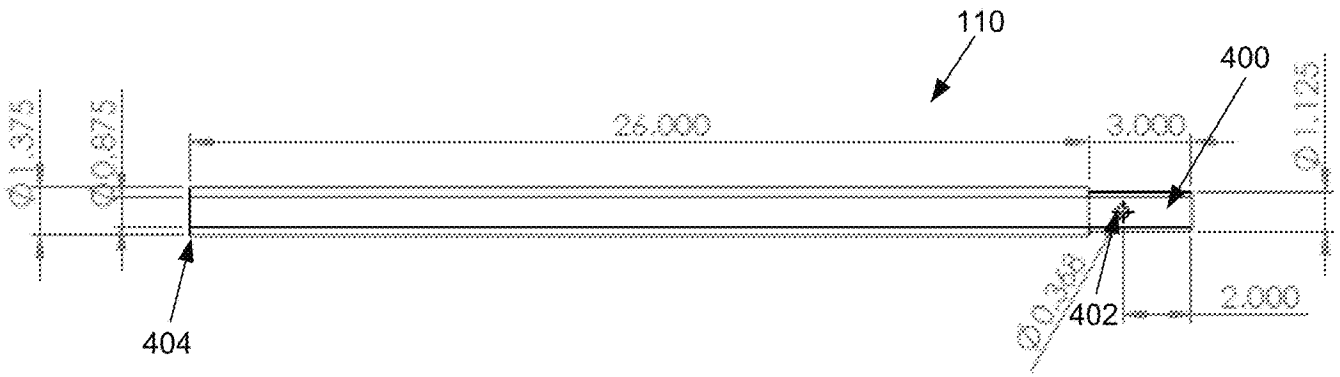
FIG. 4A illustrates a side view of an exemplary embodiment of a second tubing segment of the PDR tool.

FIG. 4A illustrates a side view of an exemplary embodiment of a second tubing segment 110 of the PDR tool 100. The second tubing segment 110 has a second length $l_2$. In an embodiment, the second length $l_2$ is approximately 26 inches. In another embodiment, the second length $l_2$ is in a range of approximately 20 inches to 32 inches. In an example, the first length $I_1$>the second length $l_2$.

A first end of the second tubing segment 110 forms or is fixedly attached to a smaller diameter tube attachment 400. The smaller diameter tube attachment 400 includes a clip aperture 402. The tube attachment 400 is configured to fit within another tubing segment 110. A second end 404 of the tubing segment 110 is configured to fit within the head 102, handle 106 or another tubing segment of the PDR tool 100.

Figure 4B:
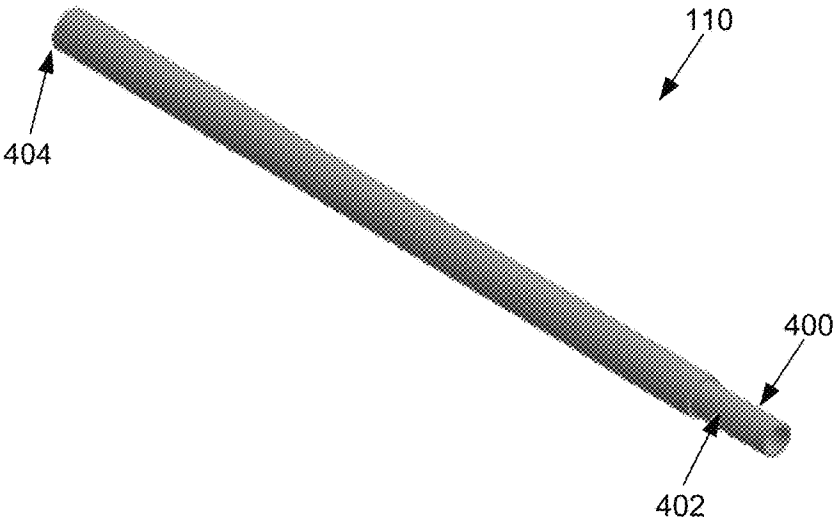
FIG. 4B illustrates an elevational view of an exemplary embodiment of a second tubing segment of the PDR tool.

FIG. 4B illustrates an elevational view of an exemplary embodiment of the second tubing segment 110 of the PDR tool 100. In an embodiment, the material of the tubing segment 110 comprises carbon fiber. Utilizing carbon fiber results in a tool that is both stronger and considerably lighter than other PDR type tools made of aluminum or steel. In addition, the tubing segment 110 is thicker in diameter, e.g. 1.25 inch in diameter with a wall thickness of 0.125 inch. In another embodiment, the diameter is in a range of approximately 1.1 inches to 1.4 inches and the wall thickness is in a range of 0.1 inches to 0.15 inches. This increased thickness creates a stronger PDR tool 100 that is less likely to bend in use. The smaller diameter tube attachment 400 has a smaller diameter but may include a same wall thickness.

Figure 5A:
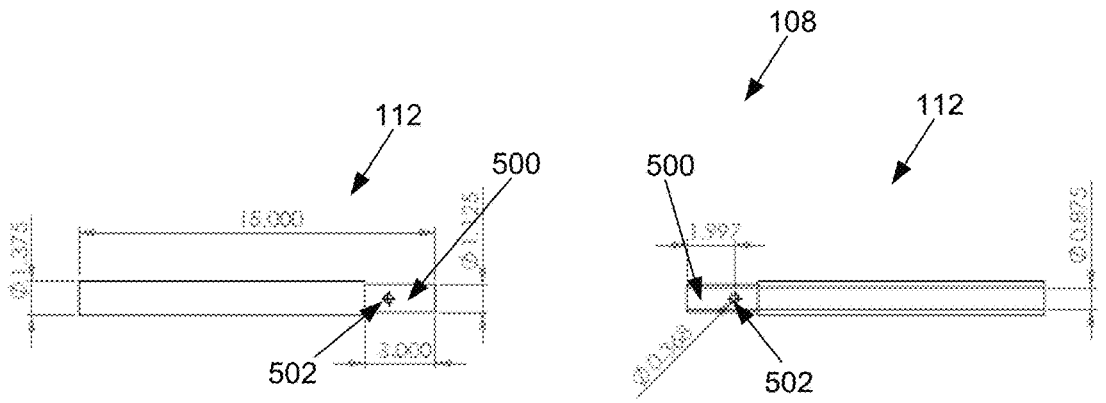
FIG. 5A illustrates a side view of an exemplary embodiment of a third tubing segment of the PDR tool.

FIG. 5A illustrates a side view of an exemplary embodiment of a third tubing segment 112 of the PDR tool 100. The third tubing segment 112 has a third length $l_3$. In an embodiment, the third length $l_3$ is approximately 12 inches. In another embodiment, the third length $l_3$ is in a range of approximately 6 inches to 18 inches. In an example, the first length $l_1$>the second length $l_2$>the third length $l_3$.

Though only three tubing segments 108, 110, 112 are illustrated, additional tubing segments that have similar or different lengths may also be used in the tubing assembly 104. Using various combinations of tubing segments or using only one or two tubing segments, the length of the tubing assembly 104 may be configurable. A technician may thus determine a desired length of the PDR tool 100 for a particular situation and assemble various lengths of tubing segments to configure the tubing assembly 104 to around the desired length.

A first end of the third tubing segment 112 forms or is fixedly attached to a smaller diameter tube attachment 500.

The smaller diameter tube attachment 500 includes a clip aperture 502. The tube attachment 500 is configured to fit within another tubing segment of the tube assembly 110. A second end of the third tubing segment 112 is configured to fit within the head 102 or the handle 106 of the PDR tool 100.

Figure 5B:
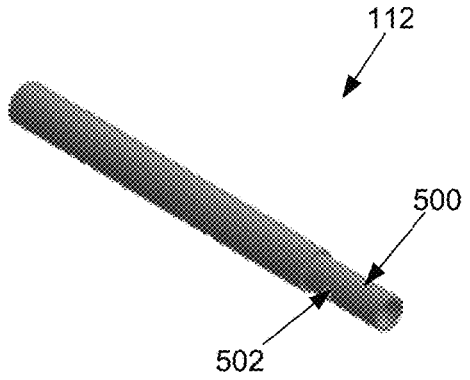
FIG. 5B illustrates an elevational view of an exemplary embodiment of a third tubing segment of the PDR tool.

FIG. 5B illustrates an elevational view of an exemplary embodiment of the third tubing segment 112 of the PDR tool 100. In an embodiment, the material of the tubing segment 112 comprises carbon fiber. Utilizing carbon fiber results in a tool that is both stronger and considerably lighter than other PDR type tools comprising aluminum or steel. In addition, the tubing segment 112 is thicker in diameter and has an increased wall thickness, e.g. 1.25 inch in diameter with a wall thickness of 0.125 inch. In another embodiment, the diameter is in a range of approximately 1.1 inches to 1.4 inches and the wall thickness is in a range of 0.1 inches to 0.15 inches. This increased thickness of the wall and diameter creates a stronger PDR tool that is less likely to bend in use. The smaller diameter tube attachment 500 has a smaller diameter but may include a same wall thickness.

Figure 6A:
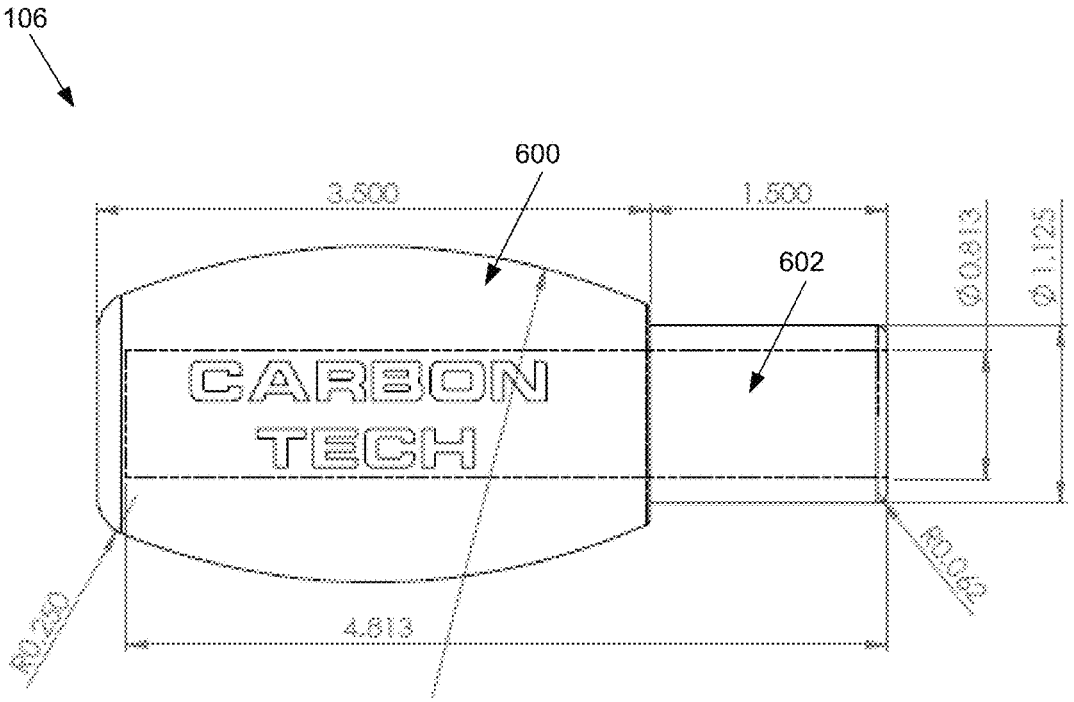
FIG. 6A illustrates a side view of an exemplary embodiment of one type of handle that may be attached to the PDR tool.

FIG. 6A illustrates a side view of an exemplary embodiment of one type of handle 106 of the PDR tool 100. This type of handle 106 has a grip portion 600 and a smaller diameter tube attachment 602. In an embodiment, the grip portion 600 is bulbous in shape for a comfortable and strong grip. In other embodiments, the grip portion 600 may have a handle bar type shape or other shapes. Since the handle 600 is attachable and detachable, different shaped handles may be attached depending on the preference of the technician.

Figure 6B:
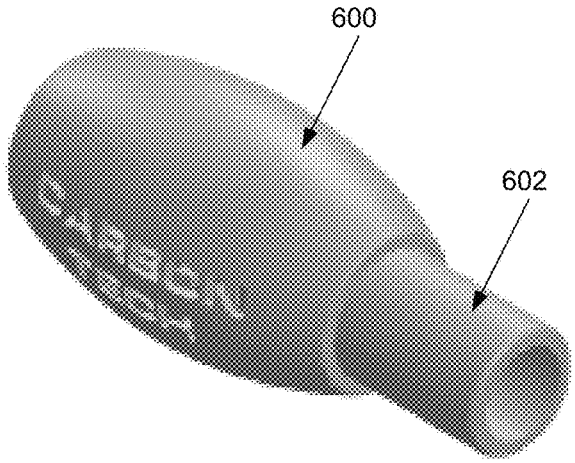
FIG. 6B illustrates an elevational view of an exemplary embodiment of one type of handle that may be attached to the PDR tool.

FIG. 6B illustrates an elevational view of an exemplary embodiment of the handle 106 of the PDR tool 100. The handle 106 of the PDR tool 100 may comprise aluminum, such as machined 6061 T6 aluminum, to decrease cost. The smaller diameter tube attachment 602 is also configured for attachment to the tubing assembly 104 using the button clip assembly. Because the handle 106 of the PDR tool 100 is removable, therefor, new and different types of handle attachments can be utilized. Because the head and handle of the PDR tool are both removable, therefor, new and different attachments can be utilized. This ability to remove and change the head 102 and handle 106 increases the utility and versatility of the PDR tool in contrast to other PDR tools.

This ability to remove and change the head 102 and handle 106 also reduces cost of the PDR tool 100 in contrast to other PDR tools. For example, the handle 106 or a head 102 may wear more quickly than a tubing assembly part. Since the parts are attachable and detachable, only the worn or broken parts of the PDR tool 100 need to be replaced over time rather than the entire tool. This reduces the overall cost of using the PDR tool 100 during its lifetime.

Embodiment of the Button Clip System

Figure 7:
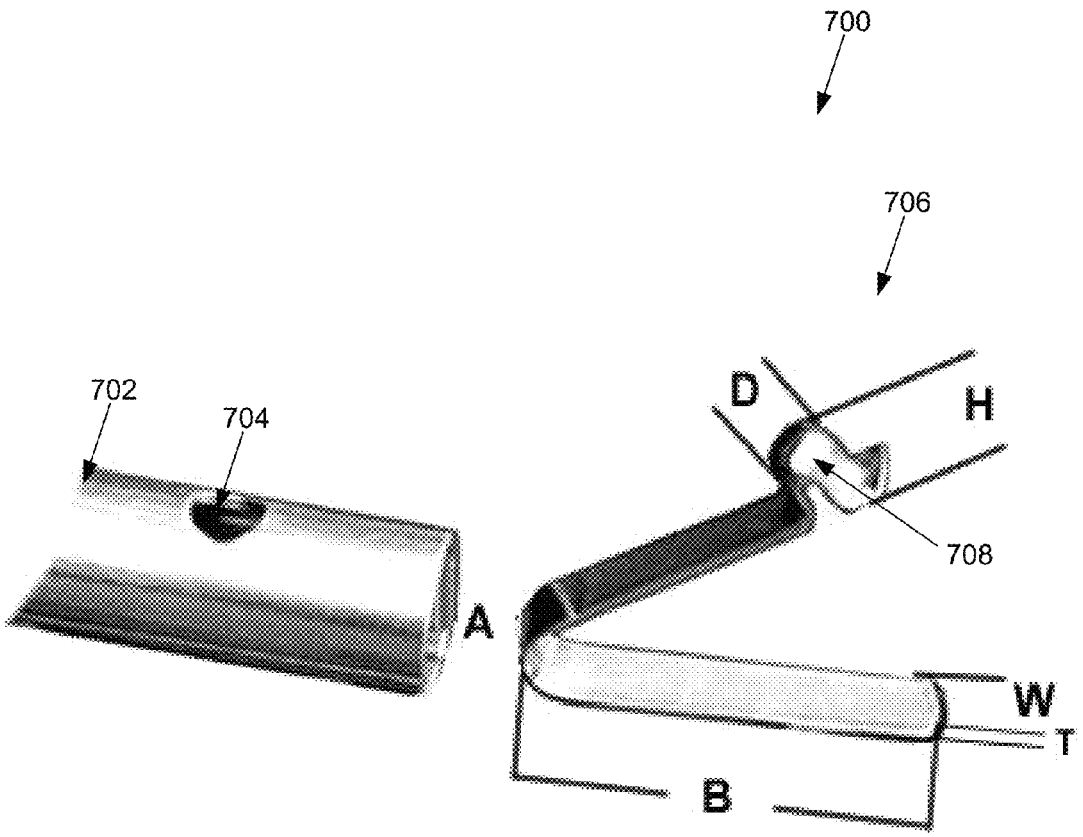
FIG. 7 illustrates an elevational view of an embodiment of a button clip system.

FIG. 7 illustrates an elevational view of an embodiment of a button clip system 700. The button clip system 700 includes a clip 706 having a protrusion 708 positioned thereon. In an embodiment, the clip 706 is configured to fit within a smaller diameter tube portion 702 of a handle 106, head 102 or tubing segment 108, 110, 112. The protrusion 708 on the clip 706 protrudes from aperture 704. The clip 706 has a frictional spring tension force that secures the protrusion 708 in position within the aperture 704. For example, the clip 706 is a U shaped metal piece wherein the inelasticity of the metal generates the frictional spring tension force when compressed within the tubing segment.

In use, with the clip 706 in position within a smaller diameter tube portion 702 of a tubing segment or handle or head, a larger diameter portion of another tubing segment is slid over the smaller diameter tube portion 702. An aperture (such as 302, 304, 402, 502) in a larger diameter portion of a tubing segment 108, 110, 112 engages with the protrusion 708. This engagement secures the components together.

To easily disassemble the components, the protrusion 708 is compressed until it disengages with at least the aperture (such as 302, 304, 402, or 502) in the larger diameter portion of a tubing segment 108, 110, 112. The larger diameter portion of the tubing segment 108, 110, 112 may then slide away from the other component until the components are separated or disassembled. The protrusion 708 of the clip 706 may be compressed until it disengages with both the aperture (such as 302, 304, 402, or 502) in the larger diameter portion of a tubing segment 108, 110, 112 and the smaller diameter tube portion 702 of a handle 106, head 102 or tubing segment 108, 110, 112.

The button clip system 700 thus enables the various components of the PDR tool 100 to be easily and quickly assembled and disassembled. In addition, the button clip system 700 is more secure than a screw/thread attachment mechanism which may become loose while the PDR tool 100 is in use.

In another embodiment, a protrusion may be formed as part of or on the smaller diameter tube portion 702 of a handle 106, head 102 or tubing segment 108, 110, 112. The protrusion may be spring loaded or otherwise compressible for attachment and detachment from an aperture formed in the larger diameter portion of a tubing segment 108, 110, 112.

Leverage System

Figure 8:
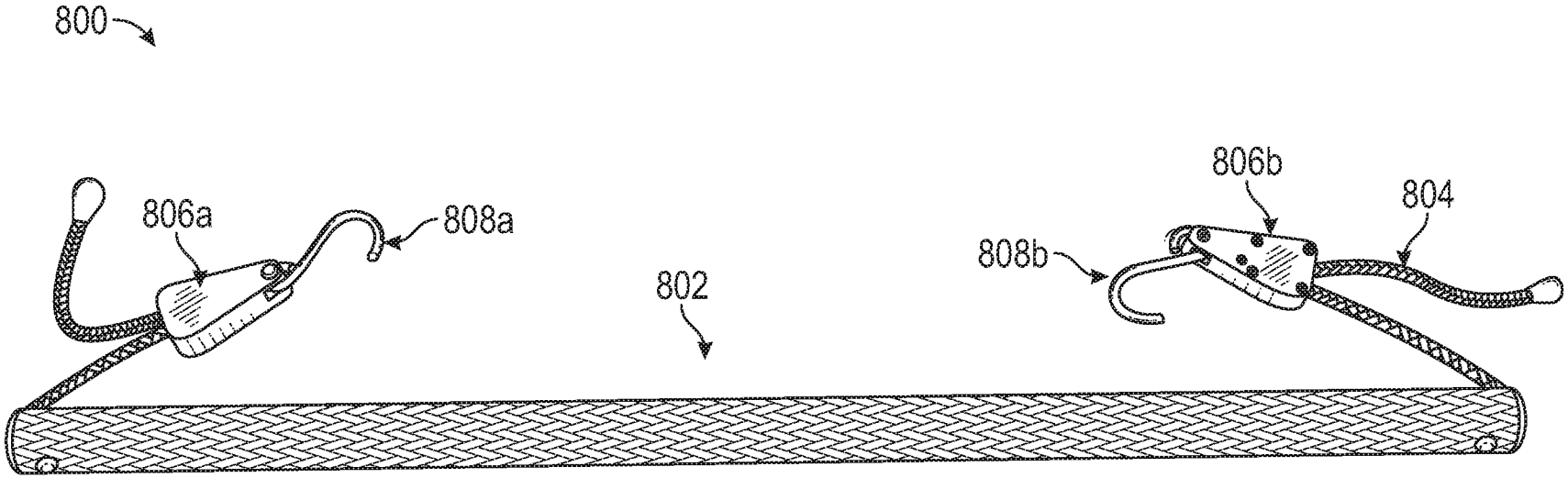
FIG. 8 illustrates an elevational view of an embodiment of a leverage system.

FIG. 8 illustrates an elevational view of an embodiment of a leverage system 800. The leverage system 800 includes a cross bar 802, a rope 804, pulleys 806*a*, 806*b* and hooks 88*a*, 808*b*. In use, when repairing dents on a roof on a vehicle, the back window or a hatch of the vehicle is removed. The leverage system 800 is then positioned from right to left across the window or hatch opening. The leverage system 800 provides a stable bar on which the tubing assembly of the PDR tool 100 may engage. The tubing assembly 104 may then be used as a lever with a point on the cross bar 802 acting as an axis or fulcrum. This lever mechanism allows a technician to apply more force to a dent or more accurately position the tubing assembly 104 on a dent.

In an embodiment, the cross bar 802 is implemented using rope 804 at each end instead of a metal chain. For example, the rope 804 may include AM STEEL BLUE rope that has over approximately 8000 lb breaking strength and resists stretching. In addition, the cross bar 802 comprises carbon fiber instead of steel or aluminum making it lighter than other types of leverage systems. In addition, the leverage system includes a ratcheting hook 808*a*, 808*b* on the pulleys 806*a*, 806*b* that adjusts a length of the rope 804 with just a push of the button on the pulleys 806*a*, 806*b*. This leverage system 800 is thus simpler than just hooks that need to be moved on chains in other leverage tools.

Figure 9:
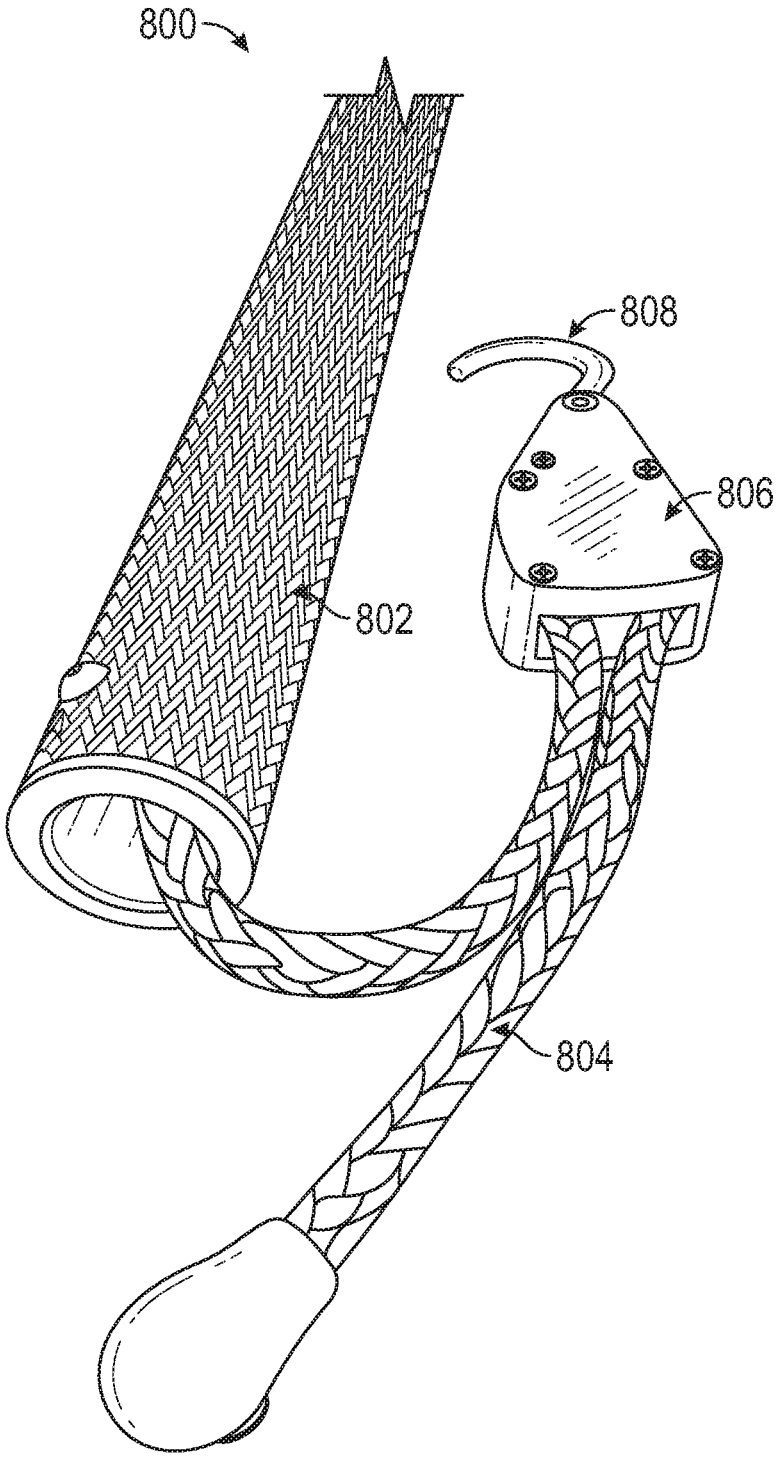
FIG. 9 illustrates another elevational view of an embodiment of the leverage system.

FIG. 9 illustrates another elevational view of an embodiment of one end of the leverage system 800. The leverage system 800 includes a cross bar 802, a rope 804, pulleys 806*a*, 806*b* and hooks 808*a*, 808*b*. In an embodiment, a single rope is threaded through a hollow interior of the cross bar 802. A first pulley 806*a* is attached to first end of the rope 804, and a second pulley 806*b* attached to a second end of the rope 804.

Figure 10:
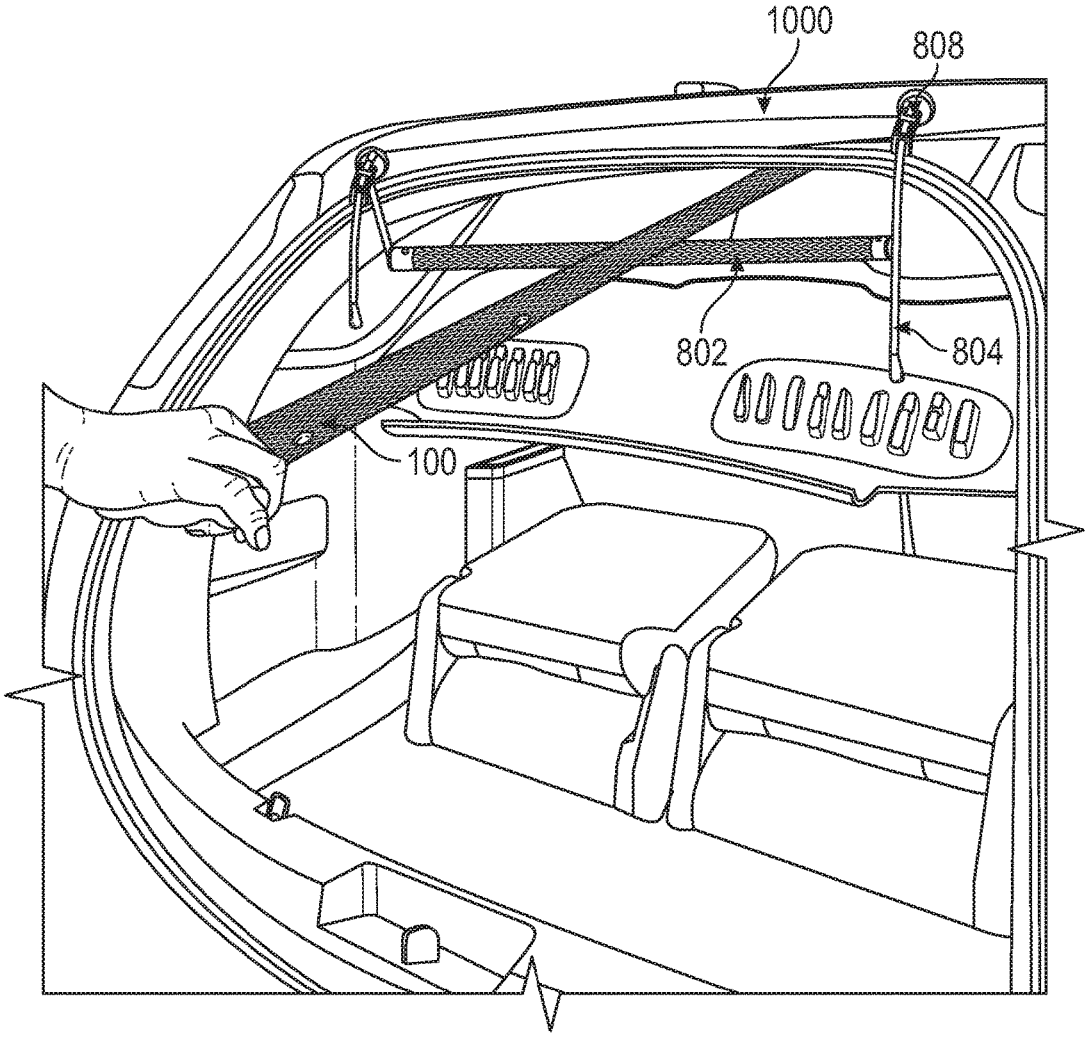
FIG. 10 illustrates an elevational view of an embodiment of the leverage system in use on a vehicle.

FIG. 10 illustrates an elevational view of an embodiment of the leverage system 800 in use on a vehicle. The hooks 808 are attached to an upper frame 1000 over a back window or hatch of a vehicle. The rope 804 is adjusted such that the cross bar 802 hangs at a preferred height. The cross bar 802 is thus positioned from right to left or horizontally across the window or hatch opening of the vehicle. The cross bar 802 may then be used as a fulcrum or axis on which the tubing assembly of the PDR tool 100 may engage. The tubing assembly 104 acts as a lever and allows a technician to apply more force to a dent or more accurately position the tubing assembly 104 on a dent.

Figure 11:
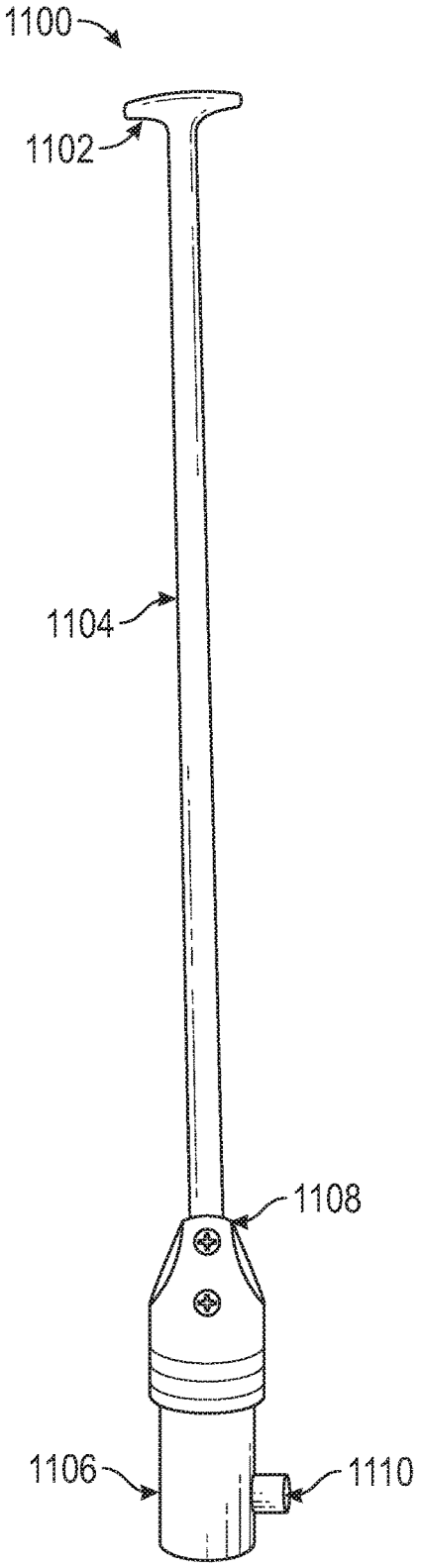
FIG. 11 illustrates an elevational view of an embodiment of another type of head that may be implemented with the PDR tool.

FIG. 11 illustrates an elevational view of an embodiment of another type of head 1100 that may be implemented with the PDR tool 100. This second type of head 1100 includes a T-shaped end portion 1102 attached to a long shaft 1104. The T-shaped end portion may have a width of approximately 1.375 in The shaft 1104 is approximately 13 inches but may be in a range from 10 inches to 16 inches. The shaft 1104 may taper in thickness. For example, the shaft 1104 may taper from a thickness of approximately 0.125 in at an attachment end 1108 to a thickness of approximately 0.0625 at the T-shaped end portion 1102. The attachment end 1108 includes a smaller diameter tube attachment 1106. The smaller diameter tube attachment 1106 includes a clip or protrusion 1110. The tube attachment 1106 is configured to fit within a tubing segment of the tubing assembly 104. The clip or protrusion 1110 engages with an aperture formed within the tubing segment 104. The clip 1110 may be used to attach and detach the head 1110 from the tubing assembly 104 for reconfiguration of the type of head or for shipping and transport.

This type of head 1100 is useful for reaching dents from a back of a long vehicle, such as a sports utility vehicle.

Figure 12:
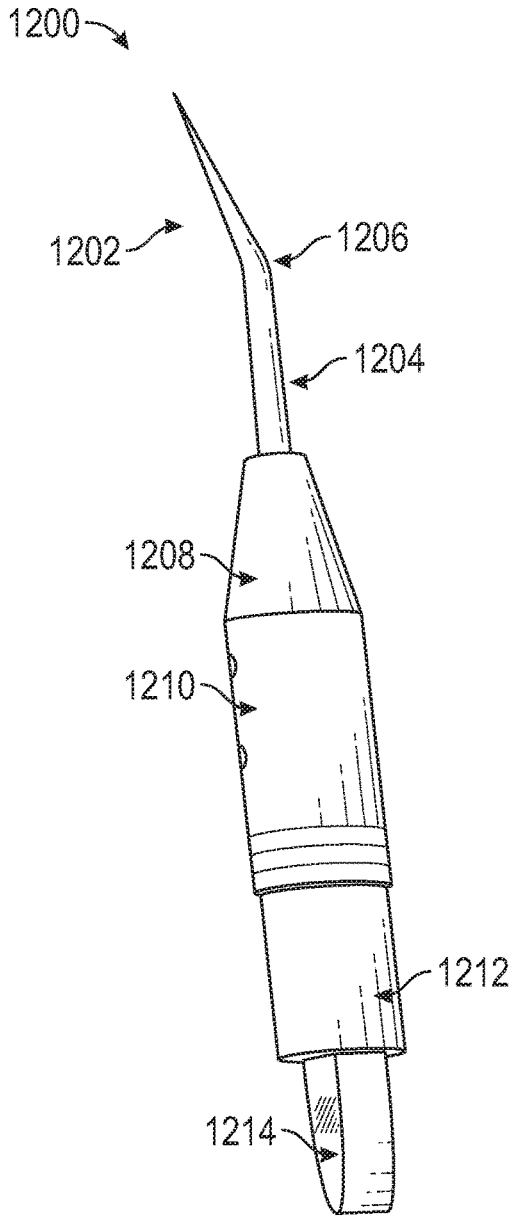
FIG. 12 illustrates an elevational view of an embodiment of another type of head that may be implemented with the PDR tool.

FIG. 12 illustrates an elevational view of an embodiment of another type of head 1200 that may be implemented with the PDR tool 100. This third type of head 1200 includes a pick 1202 angled with respect to a shaft 1204. The angle 1206 of the pick 1202 is preferably less than 90 degrees and may vary in range from 15 to 45 degrees with respect to the shaft 1204. The pick 1202 has a diameter that tappers from 7/16 in down to a 1/16 in tip. The pick and shaft together have a length of approximately 6 in but may range in length from approximately 3 in to 9 in. The shaft is attached to a conical portion 1208 that slopes to a cylindrical portion 1210. A smaller diameter portion 1212 is attached to a smaller diameter tube attachment 1214. The overall length of this type of head 1200 is approximately 10.5 inches but may vary in a range from 7.5 inches to 13.5 inches. The smaller diameter tube attachment 1214 includes a clip or protrusion (not shown). The tube attachment 1214 is configured to fit within a tubing segment of the tubing assembly 104.

This type of head 1200 is useful for dents in smaller spaces, nooks and crannies in a vehicle. For example, the pick 1202 may be used up close to braces and for fenders and side beds of a vehicle.

Figure 13:
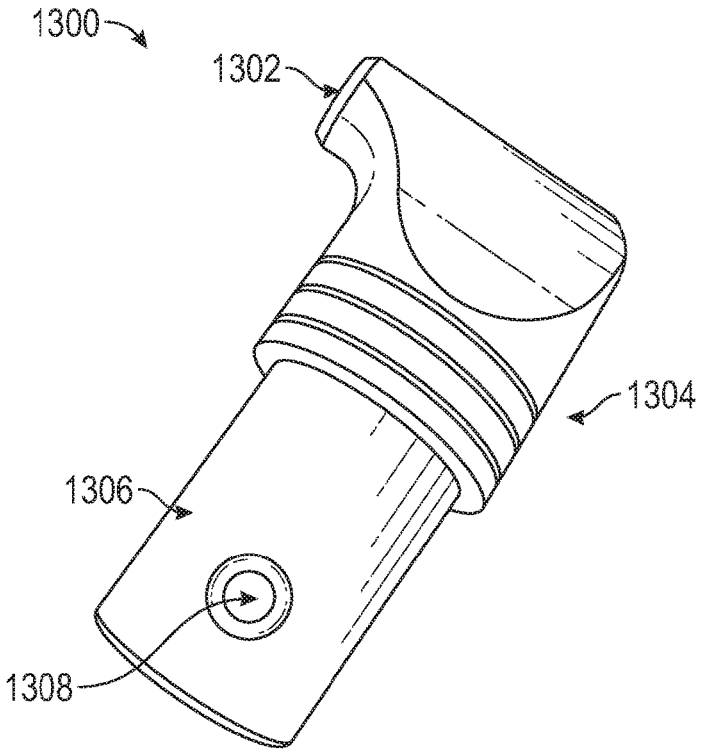
FIG. 13 illustrates an elevational view of an exemplary embodiment of a fourth type of head of the PDR tool.

FIG. 13 illustrates an elevational view of an exemplary embodiment of a fourth type of head 1300 of the PDR tool 100. The head 1300 has an attachable tip end 1302 at an approximate right angle to a shaft 1304. The attachable tip end 1302 is configured with a threaded hole wherein different tips can be attached. The shaft 1304 forms or is fixedly attached to a smaller diameter tube attachment 1306. The smaller diameter tube attachment 1306 includes a clip or protrusion 1308. The protrusion 1308 may be spring loaded or otherwise compressible for attachment and detachment from an aperture formed in the larger diameter portion of a tubing segment 108, 110, 112.

In use, a technician may select a preferred type of tip for a dent repair and attaches the preferred type of tip to attachable tip end 1302. The technician then aligns the selected tip onto a convex side of the dent and applies force to the dent to align it with the surrounding sheet metal. The PDR tool has multiple configurable tips that are attachable and detachable from the attachable tip end 1302 of the PDR tool 1300. The configurable tips allow the technician to customize the PDR tool 100 to utilize multiple tips during dent repair.

Figure 14:
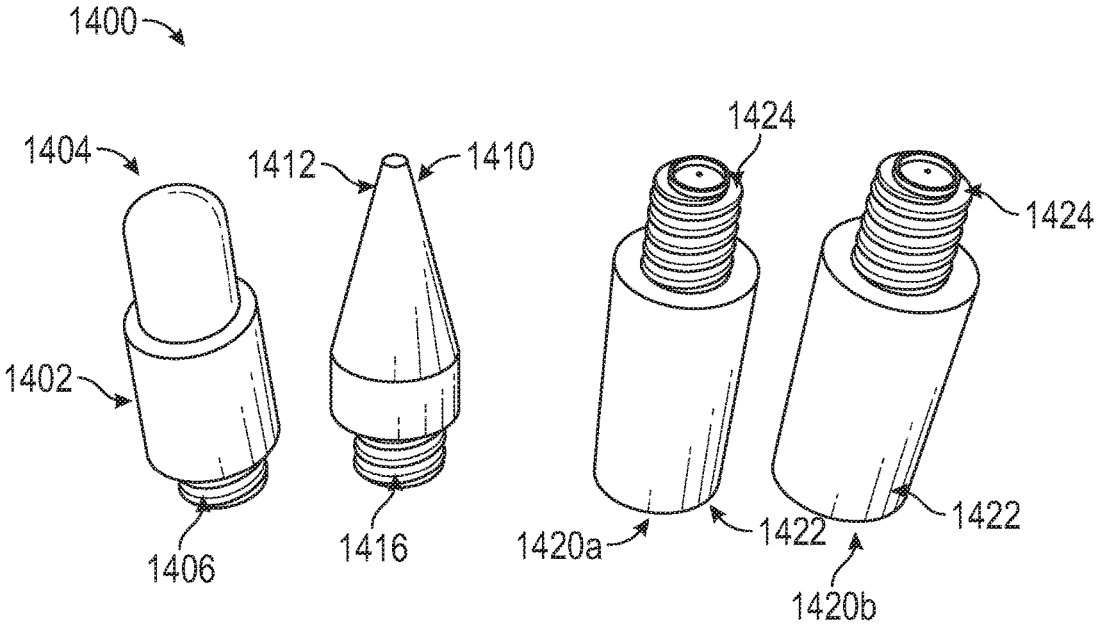
FIG. 14 illustrates an elevational view of embodiments of a plurality of tips for a head of the PDR tool.

FIG. 14 illustrates an elevational view of embodiments of a plurality of tips 1400 for a head 102 of the PDR tool 100. For example, the head 102 shown in FIG. 2 and the head 1300 shown in FIG. 13 include attachable tip ends 202, 204 and 1302 respectively. The attachable tip ends are configured for attachment to a plurality of tips 1400. For example, the attachable tip ends 202, 204 and 1302 of the heads 102, 1300 are each configured with a threaded hole wherein the different tips 1400 can be attached.

A first one of the plurality of tips includes a rounded tip 1402. The rounded tip 1402 includes a rounded end 1404 for engagement with a dent. The rounded tip 1404 also includes an attachment end 1406 with threads configured to fit and screw into the attachable tip ends 202, 204 and 1302 of the heads 102, 1300.

A second one of the plurality of tips includes a conical tip 1410. The conical tip 1410 includes a conical end 1412 that slopes to an apex or tip for engagement with a dent. The conical tip 1410 includes an attachment end 1416 with threads configured to fit and screw into the attachable tip ends 202, 204 and 1302 of the heads 102, 1300.

Though a conical tip 1410 and a rounded tip 1402 are illustrated herein, other shapes of tips may be implemented as well. For example, a tip with a pick type end may be implemented.

A third one of the plurality of tips includes an extension piece 1420*a*, 1420*b*. The extension piece 1420 includes an attachment end 1424 with threads configured to fit and screw into the attachable tip ends 202, 204 and 1302 of the heads 102, 1300. The extension piece 1420*a*, 1420*b* includes a second end 1422 having a threaded hole wherein the plurality of different tips 1402, 1410, 1420 can be attached. In one aspect, the extension piece 1420 is approximately 1 inch in length from the beginning of the threads at one end to the top of the threaded hole at the second end. In another embodiment, the extension piece 1420 may have a length in a range between approximately 0.5 inches and 1.5 inches in length.

In use, a technician may desire further reach with one of the plurality of tips 1400. One of the extension pieces 1420 may be screwed into and attached to one of the attachable tip ends 202, 204 and 1302 of the heads 102, 1300. One of the other plurality of tips 1400 may then be screwed into and attached to the extension piece 1420.

More than one extension piece 1420 may be attached to an attachable tip end 202, 204 and 1302 of a head 102, 1300 to provide further reach. For example, the technician may desire 2 inches of extension for one of the plurality of tips 1402, 1410. Assuming that a first extension piece 1420 has an approximately 1 inch length, the technician attaches a first extension piece 1420*a* to the attachable tip end 202, 204 and 1302 of the head 102, 1300. The technician may then attach a second extension piece 1420*b* to the first extension piece 1420*a*. One of the other plurality of tips 1402, 1410 may then be attached to the second extension piece 1420*b*.

Though the first extension piece 1420*a* and the second extension piece 1420*b* are shown as having a similar length, the extension pieces 1420 may have a plurality of different lengths. For example, a first extension piece 1420 may have a length of 0.5 inches while a second extension piece 1420 has a length of 0.75 inches and a third extension piece 1420 has a length of 1 inch. The technician may then use any number or sizes of extension pieces for a configurable length of the tips 1402, 1410.

As may be used herein, the term "operable to" or "configurable to" indicates that an element includes one or more of circuits, instructions, modules, data, input(s), output(s), etc., to perform one or more of the described or necessary corresponding functions and may further include inferred coupling to one or more other items to perform the described or necessary corresponding functions. As may also be used herein, the term(s) "coupled", "coupled to", "connected to" and/or "connecting" or "interconnecting" includes direct connection or link between nodes/devices and/or indirect connection between nodes/devices via an intervening item (e.g., an item includes, but is not limited to, a component, an element, a circuit, a module, a node, device, network element, etc.). As may further be used herein, inferred connections (i.e., where one element is connected to another element by inference) includes direct and indirect connection between two items in the same manner as "connected to".

As may be used herein, the terms "substantially" and "approximately" provides an industry-accepted tolerance for its corresponding term and/or relativity between items. Such an industry-accepted tolerance ranges from less than one percent to fifty percent and corresponds to, but is not limited to, frequencies, wavelengths, component values, integrated circuit process variations, temperature variations, rise and fall times, and/or thermal noise. Such relativity between items ranges from a difference of a few percent to magnitude differences.

Note that the aspects of the present disclosure may be described herein as a process that is depicted as a schematic, a flowchart, a flow diagram, a structure diagram, or a block diagram. Although a flowchart may describe the operations as a sequential process, many of the operations can be performed in parallel or concurrently. In addition, the order of the operations may be re-arranged. A process is terminated when its operations are completed. A process may correspond to a method, a function, a procedure, a subroutine, a subprogram, etc. When a process corresponds to a function, its termination corresponds to a return of the function to the calling function or the main function.

The various features of the disclosure described herein can be implemented in different systems and devices without departing from the disclosure. It should be noted that the foregoing aspects of the disclosure are merely examples and are not to be construed as limiting the disclosure. The description of the aspects of the present disclosure is intended to be illustrative, and not to limit the scope of the claims. As such, the present teachings can be readily applied to other types of apparatuses and many alternatives, modifications, and variations will be apparent to those skilled in the art.

In the foregoing specification, certain representative aspects of the invention have been described with reference to specific examples. Various modifications and changes may be made, however, without departing from the scope of the present invention as set forth in the claims. The specification and figures are illustrative, rather than restrictive, and modifications are intended to be included within the scope of the present invention. Accordingly, the scope of the invention should be determined by the claims and their legal equivalents rather than by merely the examples described. For example, the components and/or elements recited in any apparatus claims may be assembled or otherwise operationally configured in a variety of permutations and are accordingly not limited to the specific configuration recited in the claims.

Furthermore, certain benefits, other advantages and solutions to problems have been described above with regard to particular embodiments; however, any benefit, advantage, solution to a problem, or any element that may cause any particular benefit, advantage, or solution to occur or to become more pronounced are not to be construed as critical, required, or essential features or components of any or all the claims.

As used herein, the terms "comprise," "comprises," "comprising," "having," "including," "includes" or any variation thereof, are intended to reference a nonexclusive inclusion, such that a process, method, article, composition or apparatus that comprises a list of elements does not include only those elements recited, but may also include other elements not expressly listed or inherent to such process, method, article, composition, or apparatus. Other combinations and/or modifications of the above-described structures, arrangements, applications, proportions, elements, materials, or components used in the practice of the present invention, in addition to those not specifically recited, may be varied or otherwise particularly adapted to specific environments, manufacturing specifications, design parameters, or other operating requirements without departing from the general principles of the same.

Moreover, reference to an element in the singular is not intended to mean "one and only one" unless specifically so stated, but rather "one or more." Unless specifically stated otherwise, the term "some" refers to one or more. All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is intended to be construed under the provisions of 35 U.S.C. §112(f) as a "means-plus-function" type element, unless the element is expressly recited using the phrase "means for" or, in the case of a method claim, the element is recited using the phrase "step for."

What is claimed is:

1. A paintless dent removal tool, comprises:

a handle;

a tubing assembly including a plurality of tubing segments, wherein the plurality of tubing segments have a plurality of different lengths and are removably attached to configure a tubing assembly with different lengths; and a first type of head including:

at least a first end and a second end, wherein the first end and the second end are both configured with a threaded hole for attachment to a plurality of different types of tips; and a bottom end having a smaller diameter tube attachment including a protrusion, wherein the smaller diameter tube attachment fits within a larger diameter portion of one of the plurality of tubing segments; and wherein the first type of head and the handle and the plurality of tubing segments are removably attached to one another.

2. The paintless dent removal tool of claim 1, wherein the plurality of tubing segments include a first tubing segment with a length $l_1$, a second tubing segment with a length $l_2$ and a third tubing segment with a length $l_3$, wherein the first length $l_1$ is greater the second length $l_2$ and the second length $l_2$ is greater than the third length $l_3$.

3. The paintless dent removal tool of claim 1, wherein the first type of head includes a T-bar shaped head.

4. A paintless dent removal tool, comprises:

a handle;

a tubing assembly including a plurality of tubing segments, wherein the plurality of tubing segments have a plurality of different lengths and are removably attached to configure a tubing assembly with a desired length; and at least a first type of head having a plurality of ends, wherein each of the plurality of ends are attachable and detachable to a plurality of different types of tips and wherein the first type of head includes:

a T bar shaped head including a first end and a second end, wherein the first end and the second end are both configured with a threaded hole for attachment to the plurality of the different types of tips; and a bottom end of the T bar shaped head forms a first smaller diameter tube attachment including a protrusion, wherein the first smaller diameter tube attachment fits within a larger diameter portion of one of the plurality of tubing segments; and wherein the first type of head and the handle and the plurality of tubing segments are removably attached to one another.

5. The paintless dent removal tool of claim 4, wherein the plurality of tubing segments include a first tubing segment with a length $l_1$, a second tubing segment with a length $l_2$ and a third tubing segment with a length $l_3$, wherein the first length $l_1$ is greater the second length $l_2$ and the second length $l_2$ is greater than the third length $l_3$.

6. The paintless dent removal tool of claim 4, further comprising a second type of head, wherein the second type of head includes:

a T-shaped end portion;

an attachment end; and a shaft that tapers in thickness from the attachment end to the T-shaped end portion.

7. The paintless dent removal tool of claim 6, wherein the second type of head further includes:

a second smaller diameter tube attachment having a protrusion formed thereon, wherein the second smaller diameter tube attachment fits within the one of the plurality of tubing segments of the tubing assembly of the tubing assembly; and wherein the protrusion engages with an aperture formed within the one of the plurality of tubing segments of the tubing assembly.

8. The paintless dent removal tool of claim 7, further comprising a third type of head, wherein the third type of head includes:

a shaft;

a pick angled with respect to a shaft, wherein the angle of the pick varies in range from 15 to 45 degrees with respect to the shaft;

a third smaller diameter tube attachment attached to shaft.

9. The paintless dent removal tool of claim 7, further comprising a third type of head, wherein the third type of head includes:

a third smaller diameter tube attachment having a protrusion formed thereon, wherein the third smaller diameter tube attachment fits within the one of the plurality of tubing segments of the tubing assembly; and wherein the protrusion engages with the aperture formed within the one of the plurality of tubing segments of the tubing assembly.

* * * * *